US007007723B2

(12) United States Patent
Debaes et al.

(10) Patent No.: US 7,007,723 B2
(45) Date of Patent: Mar. 7, 2006

(54) WEFT YARN CLAMP FOR CLAMPING AND RELEASING WEFT YARNS OF A WEAVING MACHINE

(75) Inventors: Johny Debaes, Moorslede (BE); Ferdi Dejaegere, Dadizele (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 469 days.

(21) Appl. No.: 10/126,957

(22) Filed: Apr. 22, 2002

(65) Prior Publication Data

US 2002/0166598 A1 Nov. 14, 2002

(30) Foreign Application Priority Data

Apr. 20, 2001 (BE) ..... 2001/0272

(51) Int. Cl.
*D03D 47/34* (2006.01)

(52) U.S. Cl. ..... 139/453

(58) Field of Classification Search ..... 139/149, 139/217, 216, 194, 453, 447; 242/419.3, 242/419.4, 149
See application file for complete search history.

(56) References Cited

U.S. PATENT DOCUMENTS

| | | | | |
|---|---|---|---|---|
| 4,429,842 A * | 2/1984 | Kupper | ..... | 139/453 |
| 4,494,579 A | 1/1985 | Grandvallet et al. | | |
| 5,483,997 A * | 1/1996 | Corain et al. | ..... | 139/453 |
| 6,026,865 A * | 2/2000 | Krumm et al. | ..... | 139/453 |
| 6,119,733 A | 9/2000 | Arndt et al. | | |

FOREIGN PATENT DOCUMENTS

| | | | | |
|---|---|---|---|---|
| EP | 1016745 A2 * | 7/2000 | ..... | 139/453 |

* cited by examiner

*Primary Examiner*—Danny Worrell
(74) *Attorney, Agent, or Firm*—James Creighton Wray; Meera P. Narasimhan

(57) ABSTRACT

The invention relates to a weft yarn clamp for clamping and releasing weft yarns of a weaving machine, the weft yarn clamp comprising a first and a second clamping element, at least one clamping element of which is a clamping means controlled by an actuator and the actuator comprising a pneumatic system, controlling a clamping means working against a spring force.

11 Claims, 1 Drawing Sheet

WEFT YARN CLAMP FOR CLAMPING AND RELEASING WEFT YARNS OF A WEAVING MACHINE

This application claims the benefit of Belgian Application No. 2001/0272 filed Apr. 20, 2001.

BACKGROUND OF THE INVENTION

The invention relates to a weft yarn clamp for clamping and releasing weft yarns of a weaving machine, the weft yarn clamp comprising a first and a second clamping element at least one clamping element of which is a clamping means controlled by an actuator.

In EP 1 016 745 a device is described with a controllable weft yarn supplying and clamping device for weaving machines, in which a clamping element of a weft yarn clamp is provided for clamping and releasing a weft yarn, the said clamping element being program-controlled by an actuator, the duration of clamping and releasing being freely programmable. The actuators may be of the piezo-electric, electromagnetic, pneumatic-electric or hydraulic-electric type elements or comprise an electric motor.

The disadvantage of these devices is that the actuators have a considerable mass, because of which they are therefore less suitable to be installed on a lever moving rapidly back and forth. Moreover, these actuators take up much space and they are rather expensive.

SUMMARY OF THE INVENTION

The purpose of this invention is to provide a weft yarn clamp, not having the disadvantages mentioned.

This purpose is achieved by providing a weft yarn clamp for clamping and releasing weft yarns of a weaving machine, the weft yarn clamp comprising a first and a second clamping element of which at least one clamping element is a clamping means controlled by an actuator, and where the actuator comprises a pneumatic system controlling a clamping device acting against a spring force.

The advantage of a controllable weft yarn clamp is that the weft yarn may be picked up with an open weft yarn clamp, that only after closing the weft yarn clamp, the weft yarn is cut off and that after having been presented to the rapier head and being picked up by the rapier head, the weft yarn clamp is opened, and all this whilst being controlled by a control element of a 'controller'. The timing for opening and closing may be adjusted very easily by means of a keyboard of the control device. In each phase of the movement, the weft yarn is therefore kept or released in a positively controlled manner.

According to a preferred embodiment of the weft yarn clamp in accordance with the invention, the pneumatic system comprises an elastic body in which a pressure may be built up by means of a fluid, supplied by a controllable solenoid operated valve.

According to a specific embodiment of the weft yarn clamp in accordance with the invention the elastic body is connected on one side to an elastic hose and is connected on the other side, by means of a connecting sleeve, to a compressed air supply hose, connected to a compressed air tank via a solenoid operated valve or to the atmosphere in order to be able to regulate the pressure.

According to a preferred embodiment of the weft yarn clamp in accordance with the invention, said elastic hose is made of silicon rubber.

According to a specific embodiment of the weft yarn clamp in accordance with the invention the connecting sleeve is of metal onto which the elastic hose and said compressed air hose have been shrunk.

According to a specific embodiment of the weft yarn clamp in accordance with the invention, the said clamping means acting against a spring force is a leaf spring that is controlled by a pneumatic system.

In a particularly advantageous embodiment of the weft yarn clamp in accordance with the invention, the leaf spring is placed in a holder with a U-shaped channel above the elastic hose, the elastic hose being flattened by the pre-tension of the leaf spring.

In a still more advantageous embodiment of the weft yarn clamp in accordance with the invention, said leaf spring has a curled end.

In another still more advantageous embodiment of the weft yarn clamp in accordance with the invention, the holder shows a one-sided beveled edge for the entry opening of the weft yarn.

In yet another more advantageous embodiment of the weft yarn clamp in accordance with the invention, the said U-shaped channel is covered by a plate curled upwards at one end to form an entry for the weft yarn.

In yet another more advantageous embodiment of the weft yarn clamp in accordance with the invention, the said U-shaped channel comprises upright walls constituting a limitation of the penetration depth of a weft yarn to be clamped.

The present invention is further clarified in the following non-limiting description of a preferred embodiment of a weft yarn clamp according to the invention.

In this description reference is made, by means of reference numbers, to the attached figures, of which:

DETAILED DESCRIPTION OF THE PREFERRED EMBODIMENTS

Figure 1:
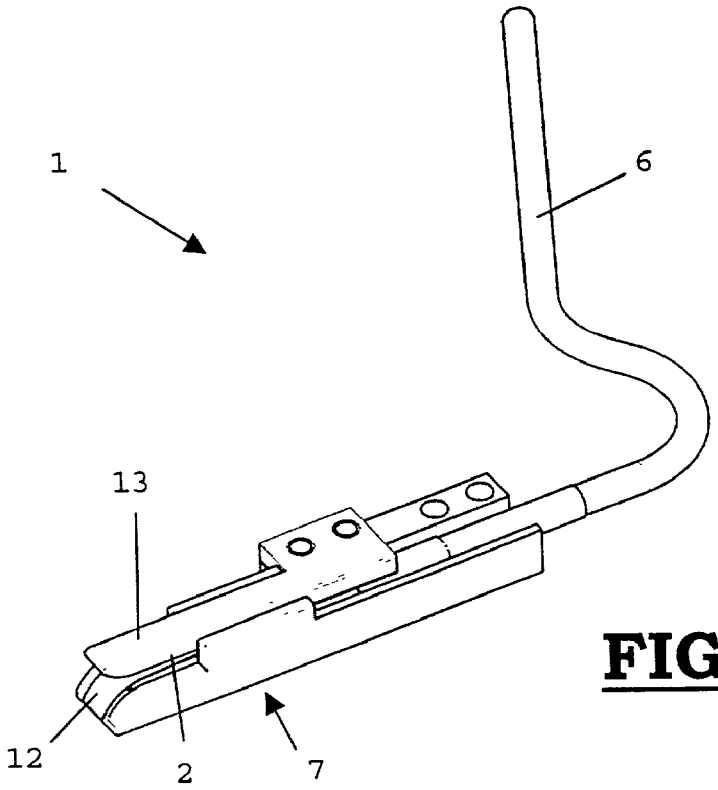
FIG. 1 is a schematic perspective representation of a weft yarn clamp according to the invention.
Figure 2:
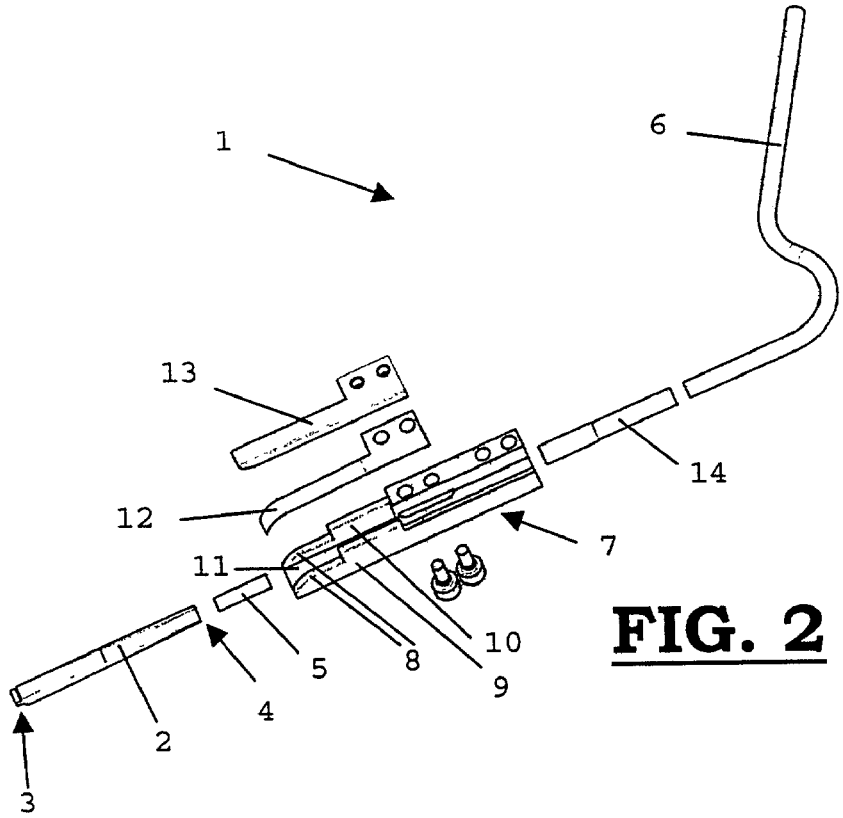
FIG. 2 is a schematic perspective representation of the various parts of a weft yarn clamp according to the invention.

The weft yarn clamp (1) according to the invention, as represented in the FIGS. 1 and 2, consists of a hose (2) of silicon rubber, which on one side (3) is glued or weld shut, and is on the other side pushed on a metal connecting sleeve (5), so that this hose (2) forms a minibellows. With this metal connecting sleeve (5) the hose (2) is connected to a polyurethane compressed air hose (6). By means of a thermal shrinking sleeve (14), the compressed air supply hose (6) and the silicon hose (2) are shrunk onto the metal connecting sleeve (5). The silicon hose (2) or minibellows is installed in a U-shaped holder (7) showing a one-sided beveled edge (8) for the entry opening of the weft yarn. Between the upright legs (9, 10) of the U-shaped channel (11) of the U-shaped holder (7) a leaf spring (12) is placed above the silicon hose (2), which flattens the silicon hose (2) by its own pre-tension. The U-shaped channel (11) is covered by an upper covering plate (13) curled up at one end to form an entry for the weft yarn. The upright legs (9, 10) of the U-shaped holder (7) will limit the penetration depth of the weft yarn.

The compressed air hose (6) is connected to a fast-operating solenoid operated valve realizing a connection to a compressed air tank or to the atmosphere. If the compressed air supply hose is connected to the atmosphere, the leaf spring (12) will flatten the silicon hose (2) and the weft yarn clamp (1) is open. The weft yarn clamp (1) will be able to pick up the weft yarn in the free opening between the leaf spring (12) and the upper covering plate (13) bent upwards. If the compressed air supply hose (6) is connected to the compressed air tank, the silicon hose (2) is expending and the leaf spring (12) is pushed against the upper covering plate (13), because of which the weft yarn is clamped. To release the weft yarn again, removing the air pressure by making a connection to the atmosphere be enough.

The U-shaped channel (7) and the bent covering plate (13) can be made of thin steel sheet, aluminum or synthetic material, so they may be made very light.

This pneumatically controlled weft yarn clamp (1) is particularly fast and efficient, it has a particularly small weight or mass and moreover it can be made at a very low cost.

What is claimed is:

1. Weft yarn clamp for clamping and releasing weft yarns of a weaving machine, the weft yarn clamp comprising a first and a second clamping element of which at least one clamping element is an actuator-controlled clamping means, wherein the actuator comprises a pneumatic system, controlling a clamping means acting against a spring force in order the exert a clamping force, wherein releasing of the weft yarns happens in a negative way with relation to the spring force, which pushes the second clamping element again away from the first clamping element.

2. Weft yarn clamp, according to claim 1, wherein the pneumatic system comprises an elastic body, in which a pressure is built up by means of a fluid, that is supplied via a controllable solenoid operated valve.

3. Weft yarn clamp, according to claim 2, wherein the elastic body is an elastic hose, closed at one end and at the other end connected to a compressed air supply hose, by means of a connecting sleeve, which is connected to a compressed air tank or to the atmosphere via the solenoid operated valve in order to be able to regulate the pressure in the elastic hose.

4. Weft yarn clamp, according to claim 3, wherein the elastic hose is made of silicon rubber.

5. Weft yarn clamp, according to anyone of the claim 3, wherein the connecting sleeve is made of metal onto which said elastic hose and said compressed air supply hose are shrunk by means of a shrinking sleeve.

6. Weft yarn clamp, according to anyone of the claim 1, wherein said clamping means acting against a spring force is a leaf spring, which is controlled by a pneumatic system.

7. Weft yarn clamp, according to claim 6, wherein said leaf spring has a curled end.

8. Weft yarn clamp, according to claim 3, wherein the leaf spring is placed in a holder with a U-shaped channel above said elastic hose, the elastic hose being flattened by the pre-tension of the leaf spring.

9. Weft yarn clamp, according to claim 8, wherein the holder has a beveled edge at one side for the entry opening of the weft yarn.

10. Weft yarn clamp, according to claim 8, wherein said U-shaped channel is covered by a plate curled upwards on one end in order to form an entry for the weft yarn.

11. Weft yarn clamp, according to claim 7, wherein the U-shaped channel comprises upright walls, forming a limitation of the penetration depth of the warp yarn to be clamped.

* * * * *